United States Patent [19]

Theurer et al.

[11] Patent Number: 4,490,947

[45] Date of Patent: Jan. 1, 1985

[54] MOBILE RAIL GRINDING MACHINE

[75] Inventors: Josef Theurer, Vienna; Johann Hansmann, Klosterneuburg, both of Austria

[73] Assignee: Franz Plasser Bahnbaumaschinen-Industriegesellschaft mbH, Vienna, Austria

[21] Appl. No.: 434,908

[22] Filed: Oct. 18, 1982

[30] Foreign Application Priority Data

Dec. 7, 1981 [AT] Austria ..... 5251/81

[51] Int. Cl.[3] ..... E01B 31/17; B24B 23/00

[52] U.S. Cl. ..... 51/178; 51/5 B; 409/298

[58] Field of Search ..... 51/178, 5 B, 5 C; 409/296, 297, 298, 308, 319; 29/33 A

[56] References Cited

U.S. PATENT DOCUMENTS

| | | | |
|---|---|---|---|
| 4,115,857 | 9/1978 | Panetti | 51/178 |
| 4,249,346 | 2/1981 | Theurer et al. | 51/178 |
| 4,309,846 | 1/1982 | Theurer et al. | 51/178 |

FOREIGN PATENT DOCUMENTS

| | | |
|---|---|---|
| 31480 | 7/1981 | European Pat. Off. . |
| 32214 | 7/1981 | European Pat. Off. . |
| 2056345 | 3/1981 | United Kingdom . |

*Primary Examiner*—Roscoe V. Parker
*Attorney, Agent, or Firm*—Kurt Kelman

[57] ABSTRACT

A continuously advancing rail grinding machine comprises a grinding tool head vertically and laterally adjustably arranged on a mounting linked to the machine frame. A drive is connected to the tool head for imparting thereto a continuously reciprocating working movement superimposed upon the working movement derived from the advancement of the machine along the track, the reciprocating working movement extending in a plane transverse to the track and over a range extending from an end point of the arcuate corner surface at the side surface of the rail head to at least one third of the periphery of the arcuate corner surface. The reciprocating working movement enables rapid and coarse removal of surface irregularities from the rail head.

4 Claims, 7 Drawing Figures

MOBILE RAIL GRINDING MACHINE

The present invention relates to improvements in a mobile machine for removing surface irregularities from a rail head of a rail of a track, particularly by grinding, the rail head having a side surface, a running surface and an arcuate corner surface connecting the side and running surfaces. More particularly, the improvement is directed to a machine of this type which comprises a machine frame mounted on the track for continuously moving in the direction of, and along, the track, a drive for advancing the machine frame in a working movement in said direction, a vertically adjustable mounting for a tool for removing the surface irregularities, the mounting being linked to the machine frame and the tool having an end face adapted to be pressed against the rail head, means for pressing the mounting against the running surface, means for vertically and laterally guiding the mounting along the rail head, and a tool head vertically and laterally movably arranged on the mounting and the tool being mounted on the tool head for rotation about an axis extending substantially perpendicularly to the end face of the tool.

U.S. Pat. No. 4,249,346, dated Feb. 10, 1981, discloses a mobile rail grinding machine for removing overflow metal, ripples and other surface irregularities from such a rail head. Two successive tool mountings are carried by the machine frame and guided along the track rails by flanged wheels, and groups of rail grinding tools, such as whetstones, are arranged on the mountings. A common drive means imparts to the mountings a reciprocating working movement in the direction of the track, which is superimposed upon the working movement in the same direction derived from the advancement of the machine along the track. This compound working movement multiplies the grinding efficiency obtainable with a single pass of the machine not only with the use of whetstones but also with rotatable grinding discs.

UK patent application No. 2,056,345, published Mar. 18, 1981, also discloses a mobile machine for removing surface irregularities from such a rail head during the advancement of the machine along the track. A tool mounting is guided along each rail substantially without play in a vertical and lateral direction. The mounting carries a tool head with a tool holder for a rail planing tool. The lateral guidance of the mounting is assured by lateral guide rollers engaging the gage and/or field side surface of the rail head below the point where the arcuate corner portion of the rail head connects the side surface to the running surface, i.e. in a surface area which has not been deformed by the flanged wheels of the trains passing over the track. Such a guidance of the tool mounting assures enduringly accurate positioning of the planing tool in relation to the rail head surface to be contoured thereby so that the rail head will be contoured exactly and with high efficiency.

European Patent Publication No. 0 031 480, published July 8, 1981, relates to a rail grinding machine whose tool mounting is equipped with a tool head for rotatable grinding discs, which is linked to the mounting by a crank drive. To obtain increased grinding efficiency and in a manner similar to the arrangement in U.S. Pat. No. 4,249,346, a reciprocating movement in the direction of the track may be imparted to the mounting but, evidently, only while the machine stands still because no means has been provided for accurately guiding the mounting along the track. The disclosed flanged wheels engaging the track rails obviously serve only for moving the machine from one working site to another. Furthermore, the disclosed rotatable grinding discs engage the rail head with their periphery, which can produce only minimal removal of surface irregularities. Since the contact surface of the disc periphery with the rail head surface is relatively small and linear, this arrangement has the disadvantage that small undulations on the arcuate corner and the running surface of the rail head extending in the track direction are simply copied by the grinding discs and are not removed. The transverse movement of the grinding disc is provided only for a tangential positioning in relation to the rail head profile and not for a true grinding of overflow metal and the like. The entire arrangement is such that only a very small surface area of the rail head can be ground so that the efficiency and accuracy attainable with this machine does not satisfy the economic requirements.

In the mobile rail grinding machine of European Patent Publication No. 0 032 214, published July 22, 1981 the tool mountings are freely suspended from the machine frame and no means is provided for pressing the mountings against the running surface of the rail head or for vertically and laterally guiding them therealong. The tools are arranged only for grinding the running surface but not the lower third of the arcuate corner surface of the rail head.

U.S. Pat. No. 4,115,857, dated Sept. 19, 1978, discloses an apparatus for on-track truing of the track rail heads. In one embodiment, the grinding tool head is pivotal in a transverse plane, the tool head being pivotally mounted on a carrier bracket connected directly to the machine frame by a parallelogram linkage and an adjustment element. No tool mounting which is pressed against the rail head running surface and vertically and laterally guided therealong is suggested. In this machine as well as in the machine of European Patent Publication No. 0 032 214, the angle under which the grinding tool engages the rail head may be adjusted but no drive is suggested for imparting to the tool an additional, continuously reciprocating working movement superimposed upon the working movement in the direction of the track.

It is the primary object of the invention to improve a mobile machine of the first-described type in a manner assuring the rapid and economical removal of rail head surface irregularities, particularly overflow metal.

This and other objects are accomplished in such a machine according to the present invention by equipping the machine with a drive means for imparting to the tool head an additional, continuously reciprocating working movement superimposed upon the working movement in the direction of the track, the additional working movement extending in a plane transverse to the track and over a range extending from an end point of the arcuate corner surface at the side surface to at least one third of the periphery of the arcuate corner surface, the additional working movement enabling rapid and coarse removal of the surface irregularities. Put another way, if lines were drawn in this transverse plane from the center of a circle defining the arcuate corner surface to the respective end points thereof at the side and running surfaces, the range of the additional working movement would extend over at least one third of the angle enclosed by these lines.

The mobile machine of this invention is of relatively simple structure while providing high operating efficiency. Relatively large surface irregularities, including particularly overflow metal extending in the direction of the track and the machine elongation at the arcuate corner of the rail head, may be removed much more rapidly than with conventional rail grinding machines, without the need for rail planing tools used normally for the removal of even larger surface irregularities. In this manner, the invention substantially increases the efficiency of mobile machines working with rotatable grinding tools, particularly discs, with respect to the depth of removal obtainable as well as working speed, without substantially increasing the construction costs of the machine. The additional transverse working movement assures a more effective contact of the tool over a larger surface of the overflow metal extending perpendicularly thereto whereby the overflow metal is removed substantially from one side to the other in the transverse direction. The relatively long and rapidly succeeding transverse reciprocating motions superimposed on the continuous working movement imparted to the tool by the advancement of the machine along the track assure in a single pass of the machine a continuous, rapid, more or less zick-zack engagement of the tool with the rail head surface, enabling a rotatable tool having an end face adapted to be pressed against the rail head to attain considerable larger removal depths than have been obtained with rail grinding tools heretofore. When combined with fine grinding, in which whetstones or grinding discs are used to remove residual minor surface irregularities, the time required for the fine grinding work is considerably reduced, thus further increasing the economic efficiency of rail contouring operations involving the machine of the invention and avoiding the use of long, relatively uneconomical rail grinding trains for removing surface irregularities from a rail head of a rail of a track.

The above and other objects, advantages and features of the present invention will become more apparent from the following detailed description of certain now preferred embodiments thereof, taken in conjunction with the accompanying drawing wherein FIG. 1 is a side elevational view of an embodiment of the mobile machine according to this invention;

Figure 6:
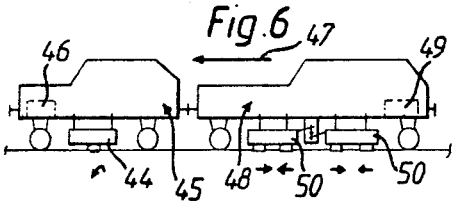
Figure 7:
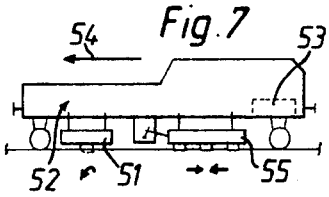

FIG. 6 schematically illustrates a mobile machine according to the invention combined with a trailing rail planing machine, in side elevation; and FIG. 7 is a similar view of a mobile machine according to the invention, carrying another mounting equipped with whetstones.

Figure 1:
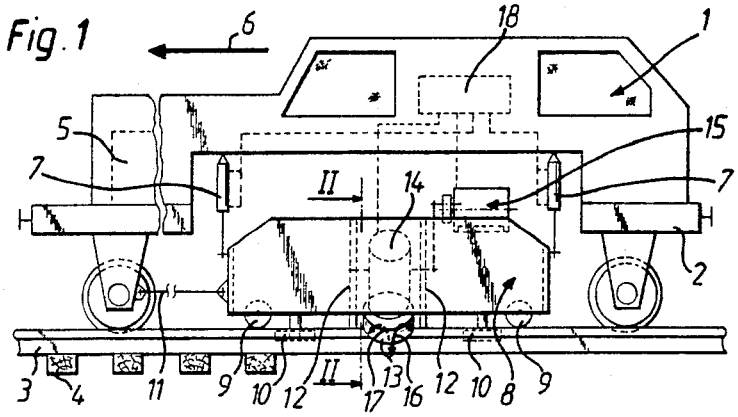
Figure 2:
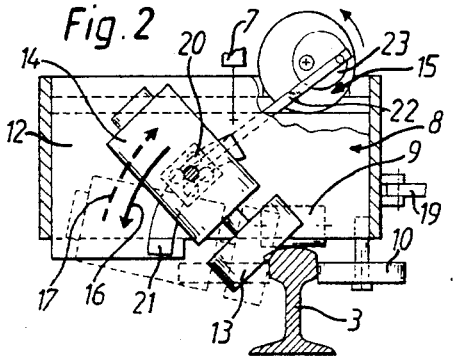
FIG. 2 is a sectional view along line II—II of FIG. 1, showing the tool mounting associated with one of the track rails on an enlarged scale.
Figure 4:
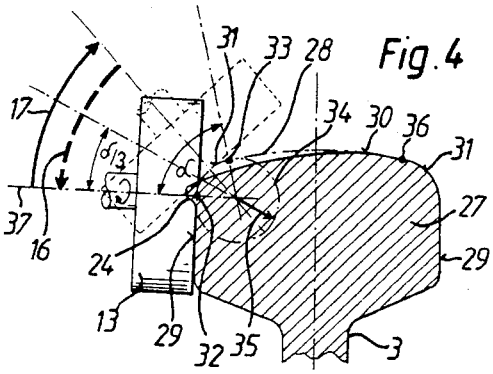
FIG. 4 shows the rail head of FIG. 2 on a greatly enlarged scale and schematically illustrates the additional, continuously reciprocating working movement of the tool.

Referring now to the drawing and first to FIG. 1, there is shown mobile machine 1 for removing surface irregularities from a rail head of rail 3 fastened to ties 4 of a track. As best shown in FIG. 4, rail head 27 has side surfaces 29, 29, running surface 30 and arcuate corner surface 31 connecting the side and running surfaces. Mobile machine 1 comprises machine frame 2 whose longitudinally spaced undercarriages mount the machine frame on the track for continuously moving in the direction of, and along, the track, as indicated by arrow 6. Drive 5 is mounted on the machine frame for advancing the machine in a working movement in the direction of arrow 6. Vertically adjustable mounting 8 for tool 13 for removing the surface irregularities is linked to machine frame 2 by substantially vertically extending hydraulic jacks 7, 7. As best shown in FIGS. 2 and 4, tool 13 has an end face adapted to be pressed against the rail head, the illustrated tool being a grinding disc. Hydraulic jacks 7 enable mounting 8 to be vertically adjusted and also constitute means for pressing the mounting against running surface 30 of the rail head. Means is provided for accurately guiding mounting 8 vertically and laterally along rail head 27, the illustrated means including first vertical guide rollers 9 engaging running surface 30 of the rail head and second lateral guide rollers 10 engaging side surface 29 of the rail head in an area of the side surface which has not been worn by the flanged wheels of passing trains (see FIG. 2). This guidance assures a substantially constant and accurate positioning of tool mounting 8 with respect to the associated rail during the continuous advancement of machine 1. During this advancement, the tool mounting is pulled along by connecting rod 11 linking each tool mounting to machine frame 2. A respective mounting is associated with each rail 3.

Figure 3:
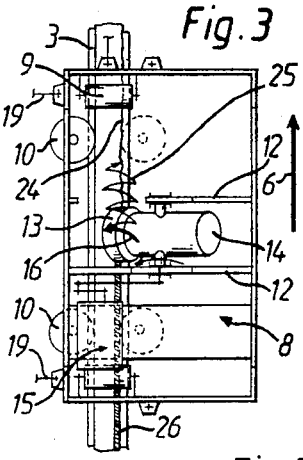
FIG. 3 is a top view of the tool mounting.

As best shown in FIGS. 2 and 3, tool mountings 8 are substantially box-shaped and are arranged mirror-symmetrically with respect to the longitudinal center line of the track. Tool head 14 is arranged on the mounting and, in the illustrated embodiment, a guide bracket is connected to the mounting and displaceably positions the tool head for movement in a direction extending substantially transversely to the machine frame elongation. The illustrated guide bracket is constituted by two spaced stiffening webs extending in the center of the mounting transversely to the machine frame elongation. This provides an advantageous and robust bearing for tool head 14 to enable the tool head to be displaced relatively to the tool mounting in a transverse direction and in a simple manner while the mounting advances in the direction of arrow 6. In this manner, the tool head is always securely positioned to assure the desired spacing of the end face of the tool from the rail head along the entire length of the rail despite the fact that the tool head is subjected to considerable forces due to the continuous reciprocating working movement imparted thereto in a manner to be described hereinafter. At the same time, the above-described guidance of tool mounting 8 provides a desirable and accurate reference for the work.

According to the present invention, drive means 15 is affixed to mounting 8 and connected to tool head 14 for imparting to the tool head an additional, continuously reciprocating working movement superimposed upon the working movement in the direction of the track, indicated by arrow 6. The additional working movement (see FIGS. 2 and 4) extends in a plane transverse to the track and over a range extending from point 32 of arcuate corner surface 31 to at least one third of the periphery of the arcuate corner surface. The additional working movement enables rapid and coarse removal of such surface irregularities as overflow metal 24. The reciprocating movement from the lowest position of tool 13 (FIG. 4) to its highest position (FIG. 2) is indicated by arcuate arrows 16 and 17.

Machine frame 2 carries central control arrangement 18 connected to drive means 15, a rotary drive for the rotation of grinding disc 13 mounted in tool head 14 and hydraulic jacks 7 by control lines for the remote control of these drives. While mobile machine 1 is moved to a working site on track rails 3, tool mountings 8 are lifted off the track. When the working site has been reached, hydraulic jacks are operated to lower the mountings and press them against the track rails for guidance therealong while guide rollers 9, 10 engage the rail heads. The grinding discs are then rotated and drive means 15 is operated to reciprocate tool head 14, whereupon drive 5 is actuated to advance the machine nonstop in the direction of arrow 6. It will be useful to control the rotary speed of tool 13 as well as the frequency of the reciprocating movement of tool head 14 steplessly to assure a smooth operation.

As shown in FIG. 2, box-shaped tool mounting 8 is guided along running surface 30 without play by guide rollers 9 and the downward pressure exerted by jacks 7 while being similarly guided laterally by guide rollers 10 engaging one side surface 29 below point 32 and horizontally extending tension rod 19 connecting the mounting to the opposite tool mounting associated with the other rack rail. A suitable drive may be provided for tensioning rod 19.

In the embodiment shown in FIG. 2, curved guide track 21 glidably guides tool head 14 during the additional working movement indicated by arrows 16, 17 and the curvature of guide track 21 corresponds substantially to a desired curvature of arcuate corner surface 31 after the surface irregularities have been removed. This structurally simple bearing for the tool head not only enhances the efficiency and economy of the machine but also improves its accuracy. The indicated shaping of the guide track enables the additional working movement of the grinding disc, in combination with the continuous working movement in the direction of the advancement of the machine, to effectuate the almost complete removal of even relatively large overflow metal portions in a single pass of the machine, which heretofore necessitated several working passes of rail grinding of planing machines.

To impart rapid reciprocating movement to tool head 14, the i11ustrated drive means comprises crank drive 23 connected to mounting 8 and connecting rod 22 extends between the crank drive and the tool head. Curved guide track 21 is defined in the rigid plate constituted guide bracket 12 and tool head 14 includes guide rollers 20 engaging guide track 21 for guiding the tool head in the guide track without play. A pivot pin projects from tool head 14 through curved guide track 21, one end of connecting rod 22 being linked to the pivot pin while its other end is connected to crank drive 23. Rotation of the crank drive disc in a counterclockwise direction indicated by the arcuate arrow will move tool head 14 and tool 13 rotatably mounted thereon downwardly in the direction of arrow 16. After half a rotation, the direction of rotation of the crank drive disc is reversed to move the tool head and tool up in the direction of arrow 17. This simple and robust mechanism assures a rapid and uniform reciprocating movement of the tool head and tool. The roller bearing provides reduced friction for the tool head bearing during this rapid reciprocating movement and the guidance assures a robust and accurate positioning of the tool head in its curved path.

The box shape of tool mounting 8 and its guidance without play by guide rollers 9, 10 are best seen in the top view of FIG. 3. As shown in broken lines, lateral guide rollers 10 may be in engagement not only with the gage side of rail 3 but also with the field side thereof. To provide secure support for tool head 14 under considerable loads, the guide bracket is constituted by two guide plates 12 displaceably positioning the tool head on the mounting. Rail head surface irregularities 24 on rail 3, i.e. overflow metal, is seen ahead of tool 13 in the direction of the working movement indicated by arrow 6. Zick-zack line 25 schematically illustrates the tool working movement which is a compound motion constituted by the linear advance of machine 1 along the track in the direction of arrow 6 and the reciprocating motion in a plane transverse thereto, as shown by arrows 16, 17. The trailing rail head surface portion from which the overflow metal has been removed by tool 13 is indicated by 26.

Figure 5:
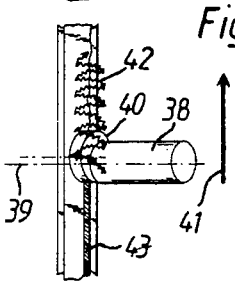
FIG. 5 is a schematic top view of another embodiment of a tool and its holder, showing a hydraulic cam drive for imparting additional vibratory motions to the tool.

According to a preferred embodiment shown in FIG. 5, further drive means, such as a hydraulically operated cam drive 38 imparts to the tool head a vibratory movement of relatively small amplitude superimposed on the additional working movement. Grinding disc 40 is mounted eccentrically about axis of rotation 39. In this manner, the compound motion of the tool head and the tool carried thereon is comprised of three components, i.e. the advancement of the machine along the track in the direction of arrow 41, the transverse reciprocating movement and the vibratory movement. This compound motion is schematically shown by line 42 and the worked corner of the rail head is seen at 43. This further enhances the effectiveness of the tool for removing surface irregularities. Additionally, the vibratory movement may be selectively used by switching the hydraulic crank drive on or off, depending on the extent of the overflow metal to be removed.

The enlarged view of FIG. 4 illustrates rail head 27 of rail 3 whose desired contour 28 (shown in chain-dotted line) has been deformed by overflow metal 24. For a smooth ride, it is desirable that the flanged wheels of passing train cars ride on a rail head surface of this desired contour, the surface of the rail head consisting of side surfaces 29 connected by running surface 30, arcuate corner surfaces 31 connecting the side and running surfaces. Each arcuate corner surface is constituted by an arc of circle 34 drawn with radius 35 in a plane transverse to the track and extending from point 32 at side surface 29 to point 33 at running surface 30. The transition of the running surface to corner surface 31 is indicated at 36.

Grinding disc 13 is rotatable about axis 37 and is shown in FIG. 4 in its lowest position which enables the end face of the grinding disc to engage and remove a major portion of overflow metal 24 since the end face of the tool extends over the entire height of side surface 29 of the rail head. In the transverse plane, axis of rotation 37 encloses an angle with a line drawn through center point 34 of the circle defining the arcuate corner surface and upper end point 33 thereof, this angle being about 75° and defining the periphery of the arcuate corner surface. According to this invention, the reciprocating working movement extends over a range from point 32 to at least one third of this periphery. Put another way, it extends over at least one third of the angle enclosed by the lines passing through the center point of the circle and arcuate corner surface end points 32 and 33, respectively. This minimum working range thus covers the lower third of the corner surface. The full working range of the reciprocating working movement is indicated by angle $\alpha$ in FIG. 4. With this arrangement, overflow metal up to a size of about 0.5 mm may be removed by tool 13 in a single pass. If the surface irregularities are larger, it will be useful to remove the same by planing.

FIG. 6 schematically illustrates an embodiment wherein mobile machine 45 is a self-propelled machine advanced in the direction of arrow 47 by drive 46 and has a respective mounting 44 associated with each rail of the track and carrying a single grinding tool. Another grinding machine 48 is connected to the machine frame of machine 45 and carries tool mountings 50 trailing mounting 44 in the working direction indicated by arrow 47. A schematically shown crank drive is arranged between the pair of tool mountings 50 to reciprocate these mountings in this direction whereby the mountings 50 are subjected to a reciprocatory movement superimposed on the working movement indicated by arrow 47. Mountings 50 preferably carry whetstones for fine grinding the rail head surfaces. If desired, yet another mounting may be carried by machine 48 and carry rail planing tools for handling large surface irregularities and/or a rail planing machine may be substituted or added to the assembly. Such an assembly will remove surface irregularities from rail heads considerably more rapidly and efficienctly than has heretofore been possible with mobile rail grinding machines, even when combined with rail planing machines, particularly in connection with the removal of such relatively large irregularities for which the use of rail planing machines was not economical. The effective work of the leading grinding tool operating in accordance with the invention limits the work of the trailing tool or tools to the removal of relatively small residual surface irregularities. However, where very large irregularities are to be removed, the use of a mounting with rail planing tools or even that of an independent rail planing machine is preferred not only for preserving the rotatable grinding tools but also to obtain a better rail head surface quality. In this manner, the removal of the surface irregularities is effected in three stages, i.e. planing, coarse grinding and fine grinding. Thus, the present invention provides selective combinations of tools adapted to different conditions for obtaining the best possible results with the highest efficiency and economy.

FIG. 7 schematically illustrates yet another embodiment in which self-propelled machine 52 is moved by drive 53 in the working direction shown by arrow 54. A respective mounting 51 is associated with each rail and carries a single tool operated in the manner of the present invention. Another mounting 55 is connected to the machine frame and trails mounting 51. Mounting 51 is reciprocable in the direction of arrow 54 and may be equipped with whetstones or with grinding discs. If a rail planing machine precedes machine 52 for the coarse removal of large rail head surface irregularities, machine 52 may be used for the fine grinding of the surface in a most effective and economical operation.

While the present invention has been described in connection with certain now preferred embodiments, many structural variations will readily occur to those skilled in the art, particularly after benefiting from the present teaching. For instance, various tools may be used for removing the surface irregularities, including milling tools. Furthermore, the range of the reciprocating working movement could be extended over the entire rail head for working simultaneously on both arcuate corner surfaces thereof, as the tools sweeps back and forth in the transverse plane.

What is claimed is:

1. A mobile machine for removing surface irregularities from a rail head of a rail of a track, the rail head having a side surface, a running surface and an arcuate corner surface connecting the side and running surfaces, which comprises (a) a machine frame mounted on the track for continuously moving in the direction of, and along, the track, (b) a drive for advancing the machine frame in a working movement in said direction, (c) a vertically adjustable mounting for a tool for removing the surface irregularities, the mounting being linked to the machine frame and the tool having an end face adapted to be pressed against the rail head, (d) means for pressing the mounting against the running surface, (e) means for vertically and laterally guiding the mounting along the rail head, (f) a tool head vertically and laterally adjustably arranged on the mounting and the tool being mounted on the tool head for rotation about an axis extending substantially perpendicularly to the end face of the tool, and (g) a drive means for imparting to the tool head an additional, continuously reciprocating working movement superimposed upon the working movement in the direction of the track, the additional working movement extending in a plane transverse to the track and over a range extending from an end point of the arcuate corner surface at the side surface to at least one third of the periphery of the arcuate corner surface, the additional working movement enabling rapid and coarse removal of the surface irregularities.

2. The mobile machine of claim 1, further comprising a curved guide track for glidably guiding the tool head during the additional working movement, the curvature of the guide track corresponding substantially to a desired curvature of the arcuate corner surface after the surface irregularities have been removed.

3. The mobile machine of claim 1, further comprising a hydraulically operated cam drive for imparting to the tool head a vibratory movement of relatively small amplitude superimposed on the additional working movement.

4. The mobile machine of claim 1, comprising a respective one of said mountings associated with each rail of the track and a single one of the tools on each mounting, and further comprising a mounting carrying a rail planing tool leading the machine in said direction.

* * * * *